US006360548B1

(12) United States Patent
Navarro

(10) Patent No.: US 6,360,548 B1
(45) Date of Patent: Mar. 26, 2002

(54) OPEN-FRONTED, REFRIGERATED SHOWCASE WITH DUAL EVAPORATORS AND DISSIPATER PANS

(76) Inventor: Ramon Munoz Navarro, 4829 E. Walnut Ave., Orange, CA (US) 92869

( * ) Notice: Subject to any disclaimer, the term of this patent is extended or adjusted under 35 U.S.C. 154(b) by 0 days.

(21) Appl. No.: 09/709,498

(22) Filed: Nov. 13, 2000

Related U.S. Application Data

(63) Continuation-in-part of application No. 09/201,778, filed on Dec. 1, 1998, now Pat. No. 6,145,327.
(60) Provisional application No. 60/089,145, filed on Jun. 12, 1998.

(51) Int. Cl.[7] ..... F25D 21/14
(52) U.S. Cl. ..... 62/93; 62/279; 62/285; 62/291
(58) Field of Search ..... 62/93, 256, 285, 62/288, 290, 291, 279

(56) References Cited

U.S. PATENT DOCUMENTS

| | | | | |
|---|---|---|---|---|
| 2,136,222 A | * | 11/1938 | Starr | 62/290 |
| 2,175,946 A | * | 10/1939 | Smith | 62/291 |
| 2,715,321 A | * | 8/1955 | Burger | 62/290 |
| 3,044,274 A | | 7/1962 | Mathis et al. | |
| 3,306,067 A | * | 2/1967 | Anglin | 62/290 |
| 3,696,630 A | | 10/1972 | Bressickello | |
| 4,766,737 A | | 8/1988 | Baxter | |
| 4,882,911 A | * | 11/1989 | Immel | 62/291 |
| 5,226,285 A | | 7/1993 | Dankowski | |
| 5,345,778 A | | 9/1994 | Roberts | |
| 5,499,514 A | * | 3/1996 | Ho | 62/291 |
| 5,941,088 A | * | 8/1999 | Kim | 62/290 |

FOREIGN PATENT DOCUMENTS

| | | |
|---|---|---|
| GB | 1322395 | 7/1973 |

* cited by examiner

*Primary Examiner*—William E. Tapolcai
(74) *Attorney, Agent, or Firm*—Breneman & Georges; William D. Breneman; Peter J. Georges

(57) ABSTRACT

A refrigerated showcase has a front opening through which a consumer can view and access foodstuffs on display. The foodstuffs are cooled by coolant air introduced through a rear wall of the showcase. An air curtain directed downwardly at the front opening minimizes coolant air loss through the opening. Dual evaporator coils are arranged in housings on different sides of a plurality of fan motors. Condensate water produced by the dual evaporator coils is pumped to a primary dissipater pan arranged on top of the showcase. Because of the large amount of condensate water produced by the dual evaporator coils, a secondary dissipater pan is provided as a back-up system for any excess condensate water. A three-way solenoid valve diverts the excess condensate water to the secondary dissipater pan when the primary dissipater pan is full.

11 Claims, 4 Drawing Sheets

OPEN-FRONTED, REFRIGERATED SHOWCASE WITH DUAL EVAPORATORS AND DISSIPATER PANS

CROSS-REFERENCE TO RELATED APPLICATIONS

This application is a continuation-in-part of application Ser. No. 09/201,778, filed on Dec. 1, 1998, now U.S. Pat. No. 6,145,327 the teaching of which is incorporated by reference thereto. Application Ser. No. 09/201,778 was derived from Provisional Application No. 60/089,145 filed on Jun. 12, 1998.

BACKGROUND OF THE INVENTION

1. Field of the Invention

The present invention relates broadly to refrigerated showcases, particularly open-fronted display and storage cases with air curtains. More specifically, the present invention relates to a refrigerated showcase having an opening through which a consumer can view and access stored items on display. In such a showcase, cooling air is introduced through a perforated interior panel with the coolant air maintained within the refrigerated compartment by an air curtain passed downwardly within the showcase opening. A dual evaporator with at least one fan sandwiched between two evaporator coils supplies the cooling air. Because of the large amount of condensate water produced by the dual evaporator, a three-way solenoid diverter valve directs the condensate water first to a primary dissipater pan and then to a secondary dissipater pan when the primary dissipater pan is full.

2. Description of the Related Art

An example of this type of showcase is described in U.S. Pat. No. 3,696,630 granted on Oct. 10, 1972, to Bressickello who discloses various self-service showcases constructed with front access openings for the purpose of displaying comestibles such as meat, eggs and vegetables. In such showcases, the cooling system includes a refrigerant coil, also known as an evaporator coil, which is located in such a position so as to cool air circulating through the showcase.

A dual evaporator with a reversible fan sandwiched between two evaporator coils is disclosed in U.S. Pat. No. 5,226,285 granted on Jul. 13, 1993, to Dankowski. However, the dual evaporator is used in a self-cleaning heat exchanger for an air conditioning system which requires more electricity than a single refrigerated showcase.

Another dual evaporator for a heat exchanger is described in British Patent No. 1,322,395 published on Jul. 4, 1973. However, the two sets of heat exchange tubes are arranged to reduce the noise level of the fan and not to increase the capacity of the cooling system.

The evaporator or refrigerant coil is sometimes oriented above a relatively small drip pan, also referred to as a dissipater pan, situated in a location so as to collect water condensation from the coil. When the water level rises to a predetermined level, this condition is sensed and a pump is activated to lift the water to an overhead dissipater pan arranged on top of the showcase. The dissipater pan may include a heating coil to dissipate any accumulated water. Other showcases eliminate condensation from the refrigerant coils by a drainage system that communicates with a floor sink.

An example of a showcase of the type where condensation from the evaporator coil is pumped to a dissipater pan arranged on top of a cabinet of the refrigerated showcase is illustrated in U.S. Pat. No. 4,766,737 granted on Aug. 30, 1988, to Baxter, II. In this prior art device, a high temperature coil of the condenser assembly is associated with the lowermost of an array of dissipater pans in order to effect the transfer of heat to the condensate which has been pumped up to the dissipater array atop the cabinet of the refrigerated showcase.

The open-fronted, refrigerated showcases with air curtains in the prior art have reached a level of efficiency such that additional improvements are not readily achieved.

It is well known in the prior art to use perforated wall dividers and/or rear panels which are angled to form an air plenum in association with the back of the showcase. These air plenums are shaped to have a decreasing volume through which cooled air is passed upwardly with the flow also passing through perforations in the wall dividers into the refrigerated showcase. This feature is illustrated in U.S. Pat. No. 3,696,630 previously mentioned and in U.S. Pat. No. 5,345,778 issued on Sep. 13, 1994, to Roberts.

It is also known to route cooled air to a bottom portion of cooling compartments where foodstuffs are stored. Bottom storage bins, where foodstuffs are placed to replenish the display shelves located above the storage area, are commonplace. However, cooling the storage area is difficult to do. Prior art devices have cooled the storage area by diverting a portion of the cooled air which is flowing upwardly from housings in which evaporator coils and air-moving fans are arranged. An example of such an arrangement is found in U.S. Pat. No. 5,345,778 just mentioned.

SUMMARY OF THE INVENTION

In accordance with the present invention, three methods of improving air curtains in open-fronted refrigerated showcases have been incorporated in the refrigerated compartment, in the refrigerant system atop the cabinet, and in the air circulation system.

As shall be fully explained below, one purpose of the present invention is to achieve optimal heat exchange by continuously trapping particles suspended in the air that flows into the components of the refrigerant system which over time becomes fouled and impedes air flow and/or the efficiency of the heat exchange. In particular, an air filter pad is used atop the showcase. This air filter pad and a precondenser coil, situated beneath the air filter pad, are both exposed and susceptible to fouling. Advantageously, these elements of the present refrigeration system are cleaned by condensate water originating at the dual set of evaporator coils. This condensate water is pumped from a lower drip pan up to the top of the showcase where a three-way solenoid diverter valve is located.

The three-way valve first directs the water to a primary dissipater pan where the water is heated and then evaporated by hot freon passing through the precondenser coil sitting on the bottom of the primary dissipater pan. When the primary dissipater pan is full, a liquid-level float valve switch is activated and sends an electrical signal to the three-way valve to stop the flow of water to the primary dissipater pan. The three-way valve then diverts the flow of the water to a secondary dissipater pan where the water is heated and evaporated by a heater coil. When the secondary dissipater pan is full, the water flows out through a trough onto the air filter pad which is cleaned by the water flowing down through it. The water then drips from the bottom of the air filter pad onto the precondenser coil which is cleaned in the primary dissipater pan. While the secondary dissipater pan has been filling up, the primary dissipater pan has been emptying because the precondenser coil has been continuing to evaporate water therefrom. The secondary dissipater pan also has a liquid-level float valve which sends an electrical signal, when the secondary dissipater pan is full, to the three-way valve to stop the flow of water thereto. The three-way valve then diverts the flow of water back to the primary dissipater pan which will be empty or almost so. The precondenser coil, preferably made of copper tubing, is inserted into the primary dissipater pan in the gas flow line between the compressor and the condenser coil. As the refrigeration gas is sucked from the evaporator coil below, the compressor places the gas under a higher pressure, thus raising the gas temperature. The hot freon gas is then pushed into the precondenser coil which has a sufficient length to evaporate the water that lands in the primary dissipater pan. The lengthy copper tubing coil between the compressor and the condenser coil functions to evaporate the water which has collected during the operation of the refrigerated showcase. The precondenser coil is situated in the primary dissipater pan, suitably resting on the bottom of the pan, with at least a portion of the coil exposed to the atmosphere in the open section of the top of the showcase. The precondenser coil also sits forward of the face of the air filter pad. Preferably, a major portion of the precondenser coil is exposed to the atmosphere. The precondenser coil also assists the condenser coil by precondensing the refrigerant. The air is pulled through the space where the air filter pad, precondenser and the primary dissipater pan are located. The air then circulates outside the precondenser coil and acts as a heat exchange medium. Precondensing refrigerant gas into liquid, moreover, makes the condensing system more efficient.

The present invention also provides an apparatus for assuring proper cooling at the bottom of the refrigerated compartment of the showcase.

The multiple fans, which move cooled air over the evaporator coils situated in the bottom of the refrigerated compartment, reduce condensation on the evaporator coils that are used to cool the air circulating in the showcase so that icing is reduced on the evaporator coils.

Water collecting on the evaporator coils is captured in an evaporation tray situated below the evaporator coils and is pumped to the top of the showcase where the condenser is located. At the top, the water flows into either a primary dissipater pan or a secondary dissipater pan which has a trough that passes the water down through the filter pad which functions to remove particulate matter and other foulants from the filter. The water from the evaporator coils both clean the air filter pad and cool the air passing through the air filter pad before the air contacts the condenser coils of the refrigeration system. The water runs down through the air filter pad into the primary dissipater pan and then onto the precondenser coil carrying refrigerant from the compressor. This precondenser coil is thus cooled by cold water originating at the evaporator coils below. The filtered air passing over the condenser coils, which air is further cooled by contact with the water, passes over and/or through the air filter pad before absorbing heat produced during refrigerant condensation. At the same time, the rate of evaporation from the primary dissipater pan, in which the precondenser coil lies, is substantially increased and the risk of water overflow is minimized. The heat generated during compression is exchanged through both the condenser coils and the precondenser coil. The latter comprises another set of coils located downstream of the condenser coils. The precondenser coil in essence functions as a heating coil to assist in the evaporation of water from the primary dissipater pan using the heat of condensation, thereby providing two desirable functions with the energy available within the refrigeration system itself, namely removing heat from the compressed refrigerant and adding heat to the condensate which accumulates in the primary dissipater pan.

Furthermore, the present invention relates to a self-service refrigerated showcase having therein an enclosure for the display of cooled foodstuffs. The enclosure has a front access opening defined by top, side and bottom housing panels. At its sides, the enclosure is defined by vertically elongated strips corresponding to the side housing panels. This enclosure provides access to the foodstuffs on display.

Also, the enclosure has other advantageous features which will become readily recognized from a study of the drawings in conjunction with the following detailed description of the invention.

DETAILED DESCRIPTION OF THE PREFERRED EMBODIMENT

Figure 1:
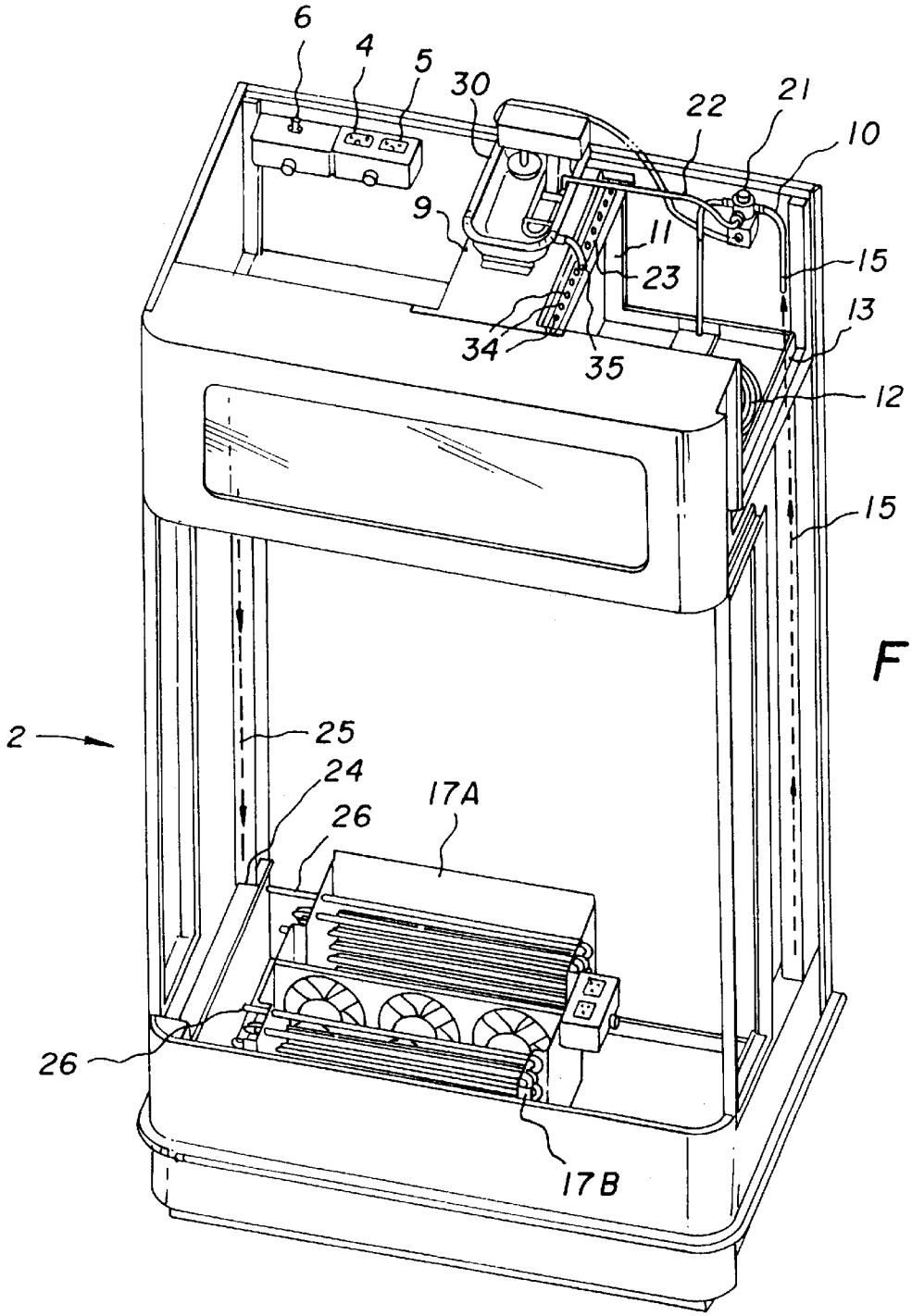
FIG. 1 is a top, partially cutaway, perspective view of the refrigerated showcase of the present invention.
Figure 2:
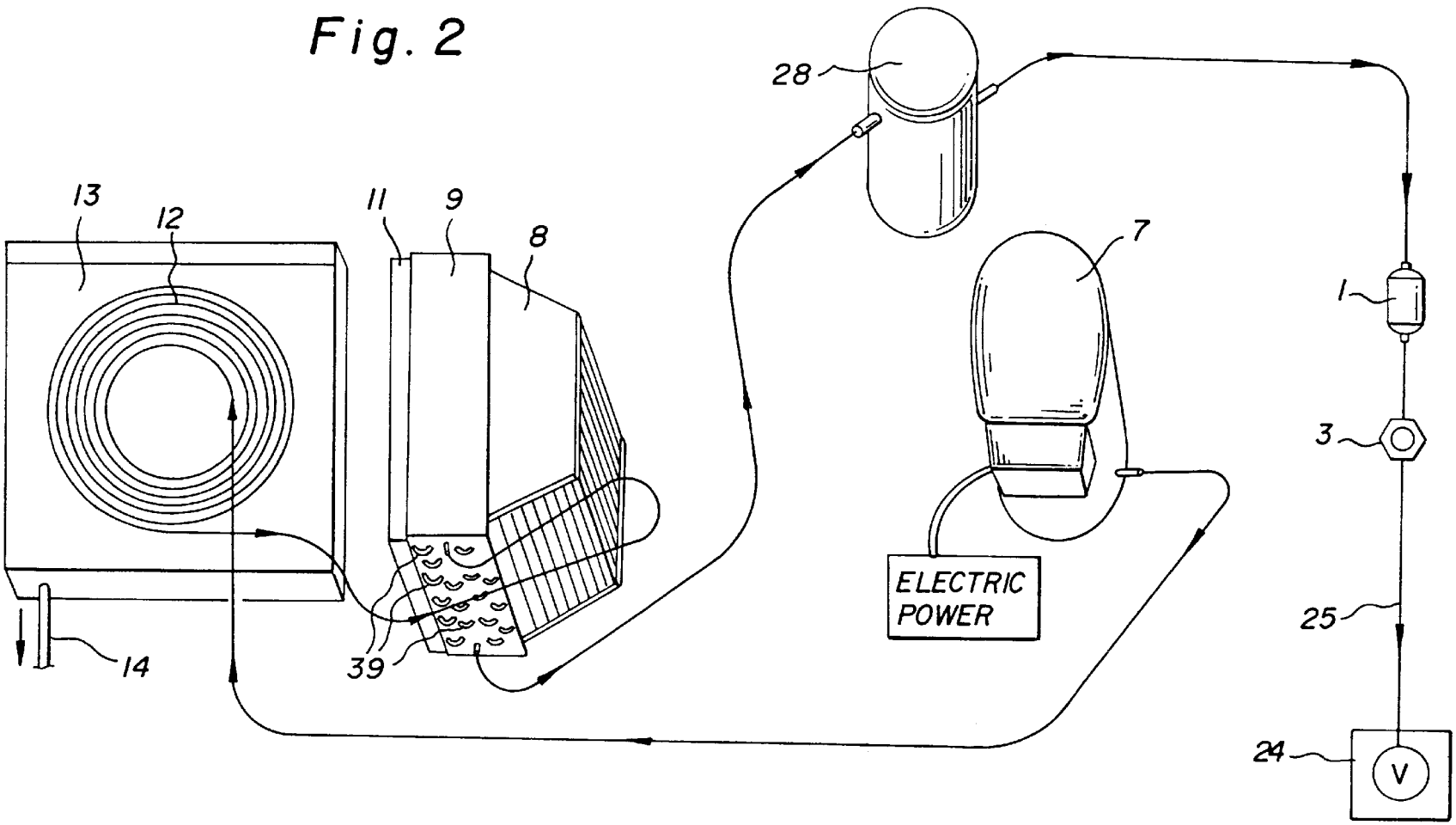
FIG. 2 is a schematic view of the cooling system on top of the refrigerated showcase.

FIG. 1 is a view of an overall refrigerated showcase 2 with several cutaway parts. As shown in FIG. 2, a compressor 7 and its associated components are situated on top of the showcase 2 of FIG. 1. Two associated components seen in FIG. 2 are a liquid line air filter pad dryer 1 and a sight glass 3. In FIG. 1, there are shown a fuse switch 4, a main switch 5, and a main "J" box 6 for supplying electric power. In FIG. 2, a suitable condenser fan motor 8 is provided by the LRC Coil Co., 9435 Sorensen Avenue, Santa Fe Springs, Calif. 90670. The condenser fan motor 8 is sold as a component of LRC Unit No. F3AM-A077. Performance data is as follows:

PERFORMANCE DATA
R-22 CAPACITIES (BTUH) AT 90° F. AMBIENT

| UNIT MODEL NO. | HP | COMP | MAXIMUM AMBIENT AT 25° F. | SATURATED TEMPERATURE / PRESSURE AT COMPRESSOR SUCTION 30° F. 54.8# | 25° F. 48.6# | 20° F. 42.9# | 15° F. 37.6# | 10° F. 32.7# |
|---|---|---|---|---|---|---|---|---|
| F3AM-A051 | ½ | JRF4 | 106° | | 4,740 | 4,290 | 3,860 | 3,460 |
| F3AM-A059 | ½ | JRF4 | 119° | 5,890 | 5,330 | 4,760 | 4,280 | 3,800 |
| F3AM-A074 | ¾ | RSN6 | 112° | 8,310 | 7,710 | 7,020 | 6,300 | 5,560 |
| F3AM-A077 | ¾ | RRG4 | 114° | 8,070 | 7,350 | 6,570 | 5,810 | 5,105 |
| F3AM-A078 | ¾ | RSN6 | 113° | | 7,403 | 6,730 | 6,030 | 5,340 |
| F3AM-A101 | 1 | REB3 | 112° | 10700 | 9,740 | 8,730 | 7,730 | 6,750 |

-continued

PERFORMANCE DATA
R-22 CAPACITIES (BTUH) AT 90° F. AMBIENT

| UNIT MODEL NO. | HP | COMP | MAXIMUM AMBIENT AT 25° F. | SATURATED TEMPERATURE / PRESSURE AT COMPRESSOR SUCTION 30° F. 54.8# | 25° F. 48.6# | 20° F. 42.9# | 15° F. 37.6# | 10° F. 32.7# |
|---|---|---|---|---|---|---|---|---|
| F3AM-A102 | 1 | REY3 | 105° | 12100 | 11100 | 10000 | 8,980 | 7,990 |
| F3AM-A105 | 1 | REK3 | 120° | 10700 | 9,600 | 8,540 | 7,570 | 6,610 |
| F3AM-A175 | 1¾ | CRC1 | 116° | 15500 | 13800 | 12200 | 10700 | 9,110 |
| F3AM-A201 | 2 | CRD1 | 113° | 16300 | 14800 | 13100 | 11500 | 9,140 |
| MAXIMUM RETURN GAS TEMP. | | | | 65° F. | 65° F. | 65° F. | 65° F. | 40° F. |

PERFORMANCE DATA R-22 CAPACITIES (BTUH) AT 90° F. AMBIENT Notes:
The return gas temperature is restricted when operating at 10° F. suction temperature. See the far right column above. Operating at higher return gas temperatures will shorten compressor life. Refer to AE Bulletin 4-1292 for additional information. Refer to the table above for the maximum allowable operating ambient temperature for the unit. This is the maximum permitted temperature of the air entering the condenser coil so as not to exceed the maximum permitted compressor condensing temperature of 140° F. (130° F. at 10° F. suction). Values are determined at suction with a clean, unobstructed condenser coil. At 30° F. when applicable, reduce the allowable ambient temperature by 5° F. For additional units, refer to Form 3.0905 (R-22 High Temperature Units). Capacities are rated at the maximum return gas temperatures shown above and 5° F. subcooling. Pressures are listed in PSIG (#) and reflect the suction pressure at the compressor intake jet. Temperatures shown are the corresponding saturation temperatures. Saturation conditions at the evaporator will be higher due to any pressure drop in the suction line.

An air filter pad 11 is placed over the face of a condenser coil box 9. This air filter pad 11 prevents airborne particulate matter from fouling the condenser coil box 9. Air drawn by the condenser fan motor 8 first passes through the air filter pad 11 and then through the condenser coil box 9. The filtered pad air is then free of contaminants which can foul the condenser coils within the box 9.

Figure 3:
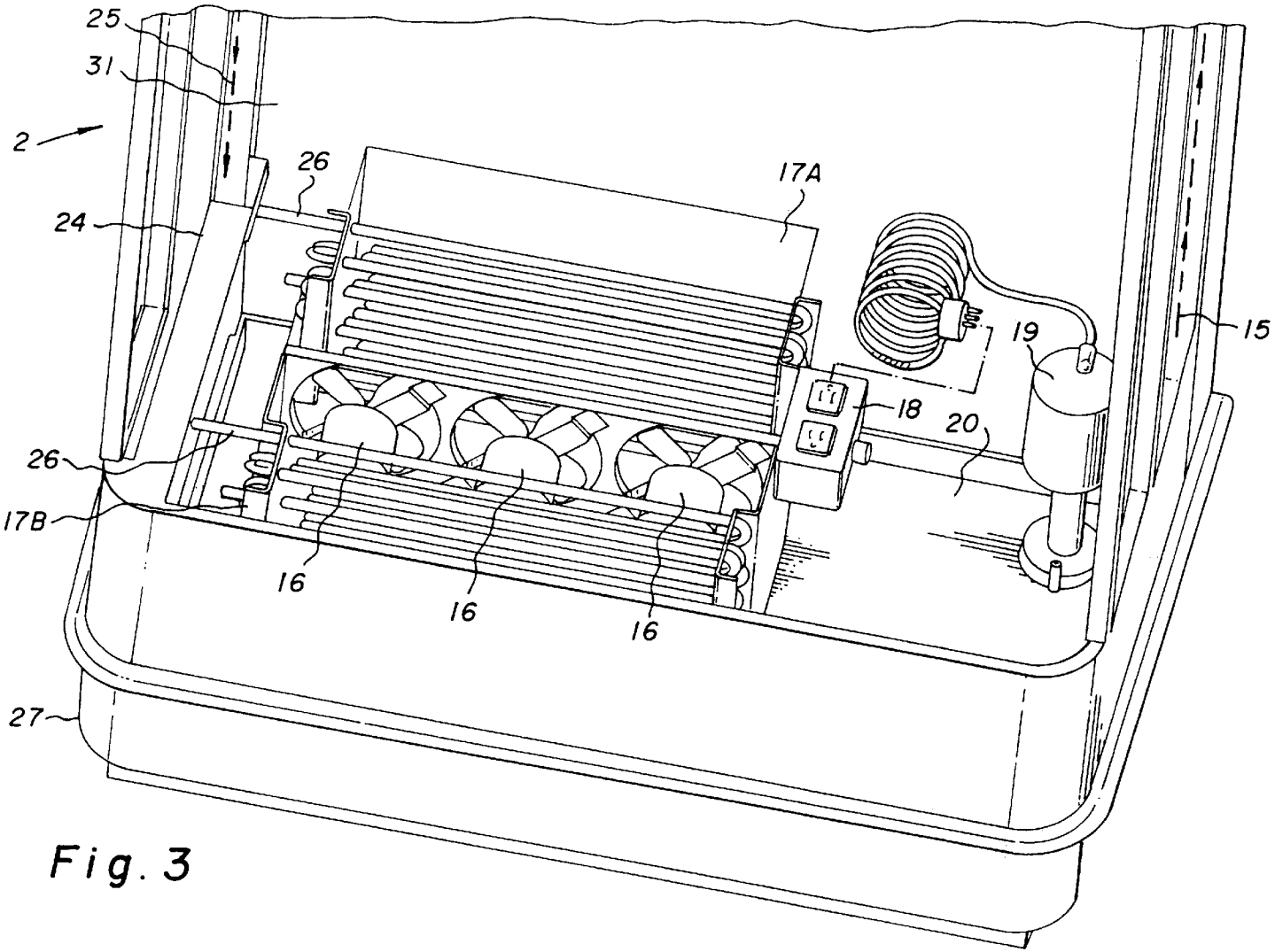
FIG. 3 is a detailed perspective view of dual evaporators and fan motors for circulating air flow from the bottom of the refrigerated showcase.

If excess water accumulates in an underlying primary dissipater pan 13 which holds a copper precondenser coil 12, the water is drained down via an overflow line 14 into a drip pan 20. Water originating from the drip pan 20 shown in FIG. 3 is pumped upwardly by a water pump 19 powered by an electric J-box 18 via a water pump line 15 which leads into a water intake tube 10 shown in FIG. 1. From the tube 10, the water flows through a three-way solenoid diverter valve 21 which directs the flow initially through a water outflow tube 22 into a secondary dissipater pan 30 having an overflow tube 35 which, in turn, directs the water into a trough 23 having a plurality of holes 34 in the bottom thereof. Because the holes 34 are small, e.g., pin-sized, the water exiting the tube 35 spreads out in the trough 23. Thus, the water spreads out evenly in the trough 23 before flowing through the holes 34 downwardly over the air filter pad 11. The water then flows passes downwardly over the precondenser coil 12 which is located in the primary dissipater pan 13. Optionally, a spray device can be provided below the air filter pad 11 to distribute the water onto the precondenser coil 12 more evenly or in any other preselected manner. A major portion of the precondenser coil 12 is exposed to the atmosphere and rests on the bottom of the primary dissipater pan 13. The water evaporates into the atmosphere from the primary dissipater pan 13.

In order to achieve a more uniform distribution of the condensate water over the entire precondenser coil 12, a perforated pan (not shown) may be placed beneath the air filter pad 11 but above the coil 12.

The precondenser coil 12 is made of ¼" copper tubing which is 30' long and which is coiled to fit inside the primary dissipater pan 13. A major segment of the coil 12 is preferably placed forward of the air filter pad 11.

As best shown in FIG. 2, the overflow line 14 leads out of the primary dissipater pan 13. The precondenser coil 12 in the primary dissipater pan 13 is placed in the coolant line between the condenser 7 and the condenser coil box 9. The coolant is then passed from the precondenser coil 12 to the condenser coil box 9 through which cool air is blown by the adjacent condenser fan motor 8. The coolant then goes sequentially through a receiver 28, the liquid line filter dryer 1, and the sight glass 3. After leaving the sight glass 3, the coolant flows down a pipe 25 to an expansion valve 24.

Returning to FIG. 1, the coolant exits the expansion valve 24 and then flows to evaporator coils 26 located in dual evaporator coil housings 17A and 17B where the air circulated in the refrigerated showcase 2 is cooled.

As shown in FIG. 2, the top of the condenser coil box 9 and the condenser fan motor 8 form a contiguous top surface which covers these units. This arrangement ensures that the air drawn through condenser coils 39 inside the box 9 is first drawn through the air filter pad 11 where the air is cooled and cleaned.

As seen in FIG. 1, forward of the air filter pad 11, the top of the refrigerated showcase 2 is exposed to the atmosphere to facilitate the evaporation of the water warmed by the heat absorbed from the precondenser coil 12 in the primary dissipater pan 13.

Because the top of the showcase 2 is open, the section rearward of the condenser coil box 9 is also exposed to the atmosphere. The compressor 7 (not shown in FIG. 1) and the components associated therewith, as well as any other equipment that is used to effect the return of the compressed liquid coolant to the bottom portion of the showcase 2, are not highly vulnerable to fouling by airborne contaminants. Thus, they may be situated in the rearward open section on top of the showcase 2.

The preferred outside dimensions of the refrigerated showcase 2 are 50.75 inches wide, 81 inches high, and 30 inches deep. The preferred inside dimensions are 48 inches wide, 59 inches high, and an average of 20 inches deep.

As seen in FIG. 2, air from the condenser fan motor 8 is passed through the condenser coil box 9 into the open section behind the condenser fan motor 8. This air which has been cleaned by the air filter pad 11 serves to circulate air around the components and to carry out particles through the top of the showcase 2, thus helping to keep the rearward part of the top section clean.

FIG. 3 illustrates a bottom section of the refrigerated showcase 2. To ensure stability, the showcase 2 has a lower steel base 27.

Figure 4:
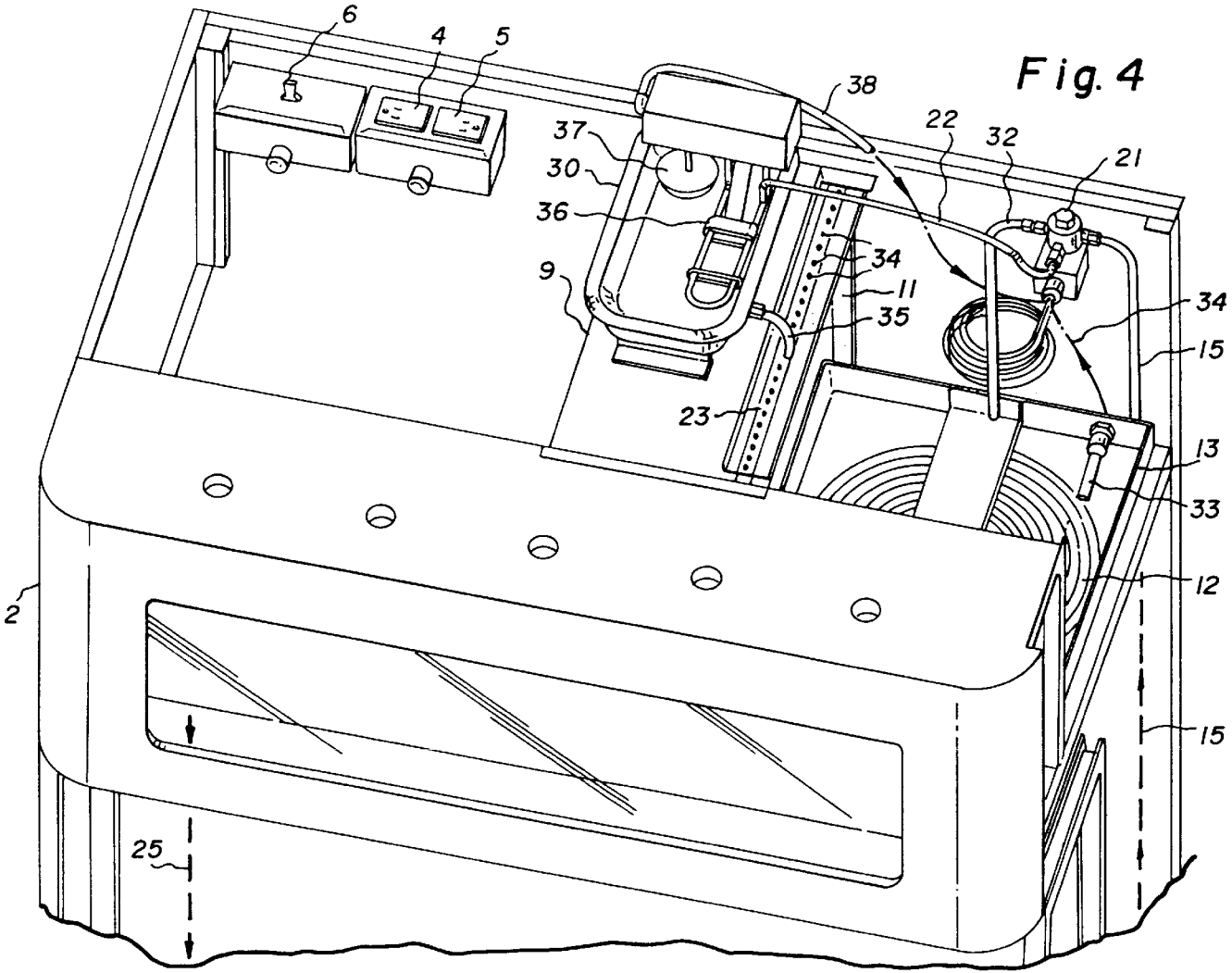
FIG. 4 is a detailed perspective view of the three-way solenoid diverter valve and the two dissipater pans on top of the refrigerated showcase.

For the showcase 2 with the internal dimensions illustrated in FIGS. 1, 3 and 4, an air flow rate of 330 cubic feet per minute is preferred for a 56-inch height of the opening.

To describe the provision for adequate air flow in the bottom of the refrigerated compartment, see FIG. 3. This aspect of the invention relates to an air handling mechanism.

As best shown in FIG. 3, the air source in the refrigerated showcase 2 is three evaporator fan motors 16 sandwiched between the dual evaporator coil housing 17A and 17B. The J-box 18 provides electric power for the fan motors 16 and the water pump 19. The rear wall 31 has interior insulation to reduce temperature changes due to external causes.

Still referring to FIG. 3, the three fan motors 16 and the two coil housings 17A and 17B may be varied in width, depending upon the width of the showcase 2. Also, the number of fan motors 16 may be changed, depending upon the length of the showcase 2.

Now referring to FIG. 4, a detailed description of the workings of the three-way solenoid diverter valve 21, the primary dissipater pan 13, and a secondary dissipater pan 30 on top of the refrigerated showcase 2 will now be made.

Water being pumped up from the bottom of the showcase 2 through the water pump line 15 enters the three-way valve 21 and is first directed through a pipe line 32 that leads into the primary dissipater pan 13 where the water is heated by the precondenser coil 12 and is evaporated by hot freon passing through the coil 12. When the primary dissipater pan 13 is full because water is pouring in through the pipeline 32 faster than the precondenser coil 12 can evaporate the water, a liquid-level float valve 33 is activated and sends an electrical signal through wire 34 to the three-way valve 21 to stop the flow of water to the primary dissipater pan 13. Alternatively, the wire 34 may be omitted and a radio signal may be sent by the float valve 33 to the three-way valve 21. The three-way valve 21 then diverts the flow of water into the outflow tube 22 which leads to the secondary dissipater pan 30 where the water is heated and evaporated by a heater coil 36. When the secondary dissipater pan 30 is full, the water flows out through the overflow tube 35 into the trough 23 which is perforated along its bottom by the plurality of holes 34. Because of the pin size of the holes 34, the water is able to spread out along the bottom of the trough 23 and flow evenly onto the air filter pad 11 which is cleaned by the water flowing down through it. The water then drips from the bottom of the air filter pad 11 onto the precondenser coil 12 which is cleaned in the primary dissipater pan 13. While the secondary dissipater pan 30 is filling up, the primary dissipater pan 13 is emptying because the precondenser coil 12 is evaporating the water from the pan 13. The secondary dissipater pan 30 has a liquid-level float valve 37 which sends an electrical signal, when the pan 30 is full, through an electric line 38 to the three-way valve 21 to stop the flow of water thereto. Alternatively, the electric line 38 may be omitted and a radio signal may be sent instead. The three-way valve 21 then diverts the flow of water back to the primary dissipater pan 13 which will be empty or almost so.

Although the primary dissipater pan 13 could be made larger to accommodate more water, there are space limitations underneath the condenser coil box 9 which prevents the primary dissipater pan 13 from being made large enough to accommodate all of the condensate water generated at the bottom of the showcase 2. For this reason, a back-up system was developed to switch the condensate water over to the secondary dissipater pan 30 which is set on top of the condenser coil box 9. Although the secondary dissipater pan 30 is shown in FIGS. 1 and 4 to be small, it can actually be made quite large so that any excess water is evaporated by the heater coil 37 in the secondary dissipater pan 30.

Returning to FIG. 3, the arrangement of dual evaporator coil housings 17A and 17B with the fan motors 16 therebetween has been found to be more effective to move large amounts of air rapidly in a minimal amount of space and with a minimal amount of energy use. Because so much condensate water accumulates in the drip pan 20 for this type of air curtain system, the excess water needs to overflow to a back-up system for dissipation.

Also in FIG. 3, the evaporation coil housing 17A is shown above the fan motor 16 while the other evaporator coil housing 17B is shown in front of the fan motors 16 so that the housing 17A, the fan motors 16 and the housing 17B are arranged in the shape of the letter L. However, they may be positioned in a straight line on the floor or one on top of the other, depending upon the space available in the bottom of the showcase 2.

Although the principles of the present invention have been illustrated herein in a particular embodiment for refrigerated showcases, it is not intended to limit such principles to that particular device alone, since the same principles are readily applicable to various other forms of devices. Thus, the principles of the present invention should be broadly construed and not limited to the specific embodiments set forth in the appended claims.

I claim:

1. A refrigeration device comprising:

(a) a refrigerated showcase having a top, a bottom, a front, and a rear wall;

(b) an air curtain disposed in the front of the showcase;

(c) dual evaporator coils arranged in housings at the bottom of the showcase and configured to cool air for the air curtain in the showcase;

(d) a plurality of fan motors sandwiched between the dual evaporator coil housings and configured to circulate cooled air in the showcase;

(e) a primary dissipater pan arranged in the top of the showcase and configured to evaporate condensate water removed from air by the dual evaporator coils; and (f) a secondary dissipater pan also arranged in the top of the showcase and configured to evaporate excess condensate water removed from the air by the dual evaporator coils.

2. A refrigeration device according to claim 1, further comprising:

(g) a three-way solenoid diverter valve arranged between the primary dissipater pan and the secondary dissipater pan and configured to divert the condensate water to the secondary dissipater pan when the primary dissipater pan is full.

3. A refrigeration device according to claim 2, wherein:

said primary dissipater pan has a precondenser coil arranged at a bottom thereof for evaporating the condensate water and a first liquid-level float valve activatable to send an electrical signal to the three-way solenoid diverter valve that the primary dissipater pan is full of the condensate water.

4. A refrigeration device according to claim 3, wherein:

said secondary dissipater pan has a heater coil arranged at a bottom thereof for evaporating the excess condensate water and a second liquid-level float valve activatable to send another electrical signal to the three-way solenoid diverter valve that the secondary dissipater pan is full of the excess condensate water.

5. In a cooling machine having a display showcase with a top and a bottom, an improvement comprising:

(a) a plurality of fan motors sandwiched between dual evaporator coils arranged at the bottom and configured to cool air on different sides of the fan motors;

(b) a primary dissipater pan arranged in the top of the showcase and configured to evaporated condensate water removed from air by the dual evaporator coils; and (c) a secondary dissipater pan also arranged in the top of the showcase and configured to evaporate excess condensate water removed from the air by the dual evaporator coils.

6. In a cooling machine according to claim 5, further comprising:

(d) a three-way solenoid diverter valve arranged between the primary dissipater pan and the secondary dissipater pan and configured to divert the condensate water to the secondary dissipater pan when the primary dissipater pan is full.

7. In a cooling machine according to claim 6, wherein:

said primary dissipater pan includes a first liquid-level float valve activatable to send a signal to the three-way solenoid diverter valve that the primary dissipater pan is full of the condensate water.

8. In a cooling machine according to claim 7, wherein:

said secondary dissipater pan includes a second liquid-level float valve activatable to send a signal to the three-way solenoid diverter valve that the secondary dissipater pan is full of the excess condensate water.

9. For a refrigerated showcase wherein the showcase has a top, a bottom and an opening in front thereof through which a consumer can view and access foodstuffs on display therein, wherein the foodstuffs in the showcase are cooled by coolant air, a method of removing excess condensate water from the showcase, said method comprising the steps of:

(a) pumping condensate water from the bottom of the showcase to a primary dissipater pan arranged at the top of the showcase; and (b) diverting the condensate water from the primary dissipater pan to a secondary dissipater pan, also arranged at the top of the showcase, when the primary dissipater pan is full.

10. In a self-service refrigerated showcase for display of foodstuffs, said showcase having a front access opening, an improvement comprising:

(a) a back-up dissipater configured to receive and evaporate excess condensate water diverted from a primary dissipater configured to receive and evaporate condensate water from evaporator coils; and (b) a three-way valve configured to divert the condensate water from the primary dissipater to the back-up dissipater.

11. In a refrigerated storage and display case having an open front section, an air curtain passing downwardly in the open front section, at least one evaporator coil, at least on fan motor configured to circulate cooled air, and a primary dissipater configured to evaporate condensate water from the evaporator coil, an improvement comprising:

(a) a back-up dissipater configured to evaporate excess condensate water from the evaporator coil; and (b) a three-way valve configured to divert the condensate water from the primary dissipater to the back-up dissipater.

* * * * *